US008467552B2

(12) United States Patent
Sferrazza

(10) Patent No.: US 8,467,552 B2
(45) Date of Patent: Jun. 18, 2013

(54) ASYMMETRIC HRTF/ITD STORAGE FOR 3D SOUND POSITIONING

(75) Inventor: Ben Sferrazza, Sunnyvale, CA (US)

(73) Assignee: LSI Corporation, San Jose, CA (US)

( * ) Notice: Subject to any disclaimer, the term of this patent is extended or adjusted under 35 U.S.C. 154(b) by 1473 days.

(21) Appl. No.: 10/943,516

(22) Filed: Sep. 17, 2004

(65) Prior Publication Data

US 2006/0062409 A1 Mar. 23, 2006

(51) Int. Cl.
*H04R 5/02* (2006.01)

(52) U.S. Cl.
USPC ..... 381/310; 381/17; 381/309

(58) Field of Classification Search
USPC ..... 381/1–23, 300–311
See application file for complete search history.

(56) References Cited

U.S. PATENT DOCUMENTS 5,521,981 A * 5/1996 Gehring ..... 381/17
6,223,090 B1 * 4/2001 Brungart ..... 700/28
6,795,556 B1 * 9/2004 Sibbald et al. ..... 381/17
7,167,567 B1 * 1/2007 Sibbald et al. ..... 381/17
7,215,782 B2 * 5/2007 Chen ..... 381/17

OTHER PUBLICATIONS

Nishino, Takanori et al Title: Interpolating HRTF for Auditory Virtual Reality, Graduate School of Engineering, Nagoya University, 1996.*
Reinhardt, Damion Title: Neural Network Modeling of the Head-Related Transfer Function, Thesis, Air Force Institute of Technology Mar. 1998.*
Begault, Durand R., "Implementing 3-D Sound Systems, Sources, and Signal Processing", 3-D Sound for Virtual Reality and Multimedia, Apr. 2000, Chapter Four, AMES Research Center, Moffett Field, CA, 61 pages.

* cited by examiner

*Primary Examiner* — Vivian Chin
*Assistant Examiner* — Fatimat O Olaniran
(74) *Attorney, Agent, or Firm* — Alexander J. Neudeck; Cochran Freund & Young LLC

(57) ABSTRACT

A method and system for reducing head related transfer function (HRTF) storage requirements for 3-D sound processing of an input sound having a specified source angle increment is provided. Interaural time difference (ITD) values are selected based directly on the source angle increment; and HRTFs for processing the input sound are stored in angle increments larger than the source angle increment.

14 Claims, 5 Drawing Sheets

ASYMMETRIC HRTF/ITD STORAGE FOR 3D SOUND POSITIONING

FIELD OF THE INVENTION

The present invention relates to sound processing, and more particularly to a method and system for asymmetrically storing HRTF/ITD measurement for 3-D sound positioning.

BACKGROUND OF THE INVENTION

To find the sound pressure that an arbitrary source x(t) produces at the ear drum, all that is required is the impulse response h(t) from the source to the ear drum. This is called the Head-Related Impulse Response (HRIR), and its Fourier transform H(f) is called the Head Related Transfer Function (HRTF). The HRTF models the sound filtering characteristics of the human pinna (projecting portion of the external ear) and torso (a human trunk) and captures all of the physical cues to the source localization. Once the HRTF for the left ear and the right ear are known, accurate binaural signals can be synthesized from a monaural source. Most HRTF measurements essentially reduce the HRTF to a function of a sound's azimuth, elevation and frequency.

FIG. 1A is a conceptual illustration of 3-D sound filtering using HRTF. Implementing 3D sound positioning requires filtering a monophonic, non-directional input sound 10 with left and right ear HRTFs 18*a* and 18*b* that are associated with a particular radial angle 12 from a listener's position 16. In some sound processing environments, this radial angle 12 is azimuthal. Typically, a software program inputs the sound 10 to a sound processor and specifies the angle 12 at which the input sound 10 should be filtered to be perceived as if it originated from that position. When the left ear HRTF 18*a* and right ear HRTF 18*b* associated with the specified angle 12 are applied to the input sound source 10, an Interaural Intensity Difference (IID) and an Interaural Time Difference (ITD) is established between the sounds that arrive at the listener's ears. The IID represents the difference in the intensity of the sound reaching the two ears, while the ITD represents the difference between the time that the sound reaches the left and right ears. Each HRTF includes a magnitude response and the phase response, where the magnitude response of the HRTF includes the IID, which is frequency dependent, and the phase response of the HRTF includes the ITD, which is frequency dependent.

In some sound processor architectures, minimum phase versions of the HRTF filters are used that no longer have the ITD inherent in the phase response of the filters. Instead, an ITD delay 22 representing the average group delay of each HRTF, is used to artificially insert the ITD by delaying the contralateral (far) ear's input sound sequence to the appropriate HRTF 18 by a number of samples. When designing a 3-D sound system, a designer may choose a particular library of HRTF measurements from different sources on the basis of user preference or behavioral data.

FIG. 1B is a block diagram graphically illustrating how minimum phase versions HRTF measurements are conventionally stored. Although many formats are available for storing a library of HRTF measurements 30, the library 30 typically includes the left HRTF 18*a*, the right HRTF 18*b*, and optionally the ITD 22 for each allowable angle increment of the input sound 12 from 0 and 360 degrees. Each HRTF 18 typically comprises some number of coefficients, e.g., thirty-two 16-bit coefficients is not uncommon. Rather than being stored, the ITD 22 may be calculated directly from the angle 12 specified for the input sound 10 during sound processing.

Whether the ITD 22 is stored or calculated, what is important to note is that for what ever increment the source angle 12 may be specified, that same increment is used to select the ITD 22.

A problem with implementing 3D sound positioning in hardware is the large memory requirements for storing the filter coefficients of the HRTFs 18 for every angle 12 that is needed. If it is decided to store HRTFs 18 for every 1 degree of azimuth, for example and thirty-two, 16-bit coefficients are used per HRTF 18, then over 23000 bytes of memory would be required. This estimate assumes using symmetry of the head and only storing the left and right ear HRTFs for one side of the head, where the left and right ear HRTFs 18 would be swapped when positioning is done on the opposite side of the head. If elevational positioning is also implemented or if higher order filters are used, these storage requirements may quickly become a burden on the design. In low-cost designs, where die or board area is to be kept to a minimum, it is imperative to reduce these storage requirements as much as possible.

In determining the location of a 3D positioned sound, it is the ITD 22 that offers a more dominating perceptual cue over the IID. In this regard, it is important to provide a high degree of granularity with the 3D position angle in order to allow many more distinct 3D positions, largely created by the ITD 22. The shortcoming of this approach is the need to store the HRTF coefficients 18 along and to select the ITD 22 for all angles.

One possible method to reduce the storage requirements would be to use a larger angle increment, such as 10 degrees, rather than the 1 degree increment used in the example above. The tradeoff with such an implementation is not providing as many distinct positions to place the 3D sound. For a moving object that passes through several successive angles, this would likely create jumpiness in the sound and, in the case when interpolative smoothing is not implemented, the sound will severely crackle.

In an attempt to overcome the shortcomings of the above implementation in which large angle granularity is used, it may seem natural to allow smaller granularity by measuring less angles and simply interpolate HRTF coefficients 18 of the missing angles. Besides the obvious computational cost of having to do so, interpolation in the time domain will not result in a magnitude response that lies between the two available HRTFs 18. This would likely create distorted magnitude responses for the interpolated HRTFs, and interpolating in the frequency domain with any degree of accuracy is much too costly.

Accordingly, what is needed is a method and system for reducing HRTF storage requirements for 3-D sound positioning. The present invention addresses such a need.

BRIEF SUMMARY OF THE INVENTION

The present invention provides a method and system for reducing head related transfer function (HRTF) storage requirements for 3-D sound processing of an input sound having a specified source angle increment. According to the present invention, interaural time difference (ITD) values are selected based directly on the source angle increment, while HRTFs for processing the input sound are stored in angle increments larger than the source angle increment.

According to the method and system disclosed herein, ITD values are still used based on the source angle increment, but because the set of left and right HRTF coefficients do not have to be stored for every source angle increment, the present invention effectively reduces HRTF storage requirements. For a sound that is stationary at the same angle for many samples, this also reduces the number of accesses to memory. This invention will further reduce the number of required memory accesses of even a moving 3D sound, potentially providing a considerable savings in power dissipation. Asymmetrical HRTF/ITD storage offers several benefits for low-power, low-cost 3D sound solutions, while making a small compromise in quality.

DETAILED DESCRIPTION OF THE INVENTION

The present invention relates to a method and system for reducing HRTF/ITD storage requirements for 3-D sound positioning. The following description is presented to enable one of ordinary skill in the art to make and use the invention and is provided in the context of a patent application and its requirements. Various modifications to the preferred embodiments and the generic principles and features described herein will be readily apparent to those skilled in the art. Thus, the present invention is not intended to be limited to the embodiments shown, but is to be accorded the widest scope consistent with the principles and features described herein.

Considering the ITD values 22 in some sound processors may be artificially inserted and represent a number of samples to delay the input sound to the contralateral ear by, the memory requirements for the ITD values 22 are almost negligible in comparison to the large amounts of data required for the HRTF coefficients.

Accordingly, present invention provides a method and system for reducing the number of HRTF coefficients that need to be stored by storing the HRTF coefficients asymmetrically in comparison with how the ITD values are selected. Given a source angle increment for an input sound, ITD values are selected at the same angle increment, but the HRTFs are stored in angle increments larger than the source angle increment. Stated differently, a single HRTF, which includes left and right coefficients, is stored for a region of angles, where each region comprises multiple angle increments.

Figure 1A:
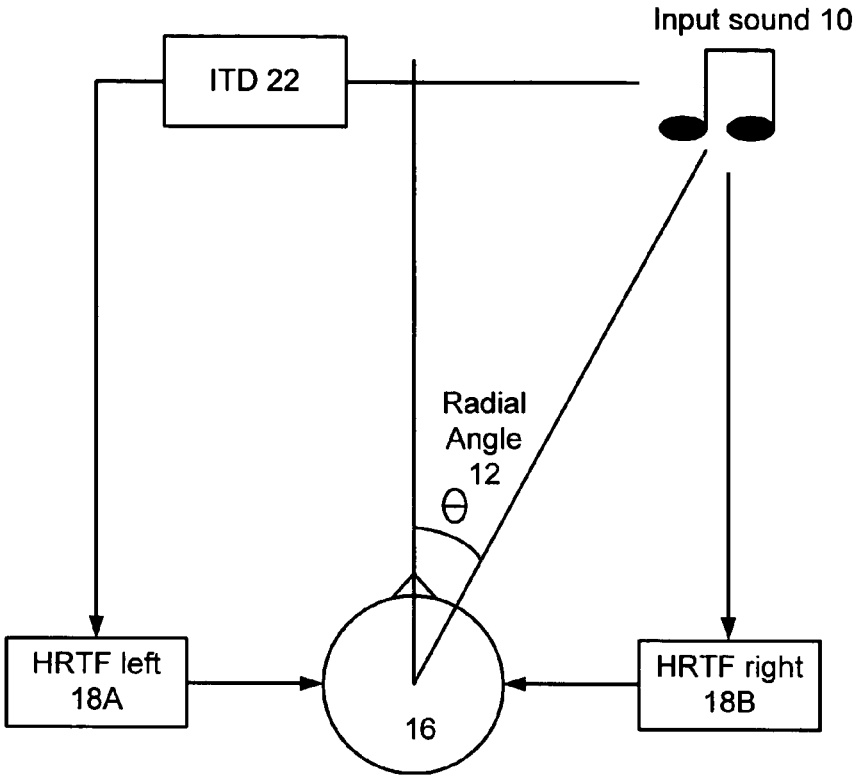
Prior Art FIG. 1A
FIG. 1A is a conceptual illustration of 3-D sound filtering using HRTF.
Figure 1B:
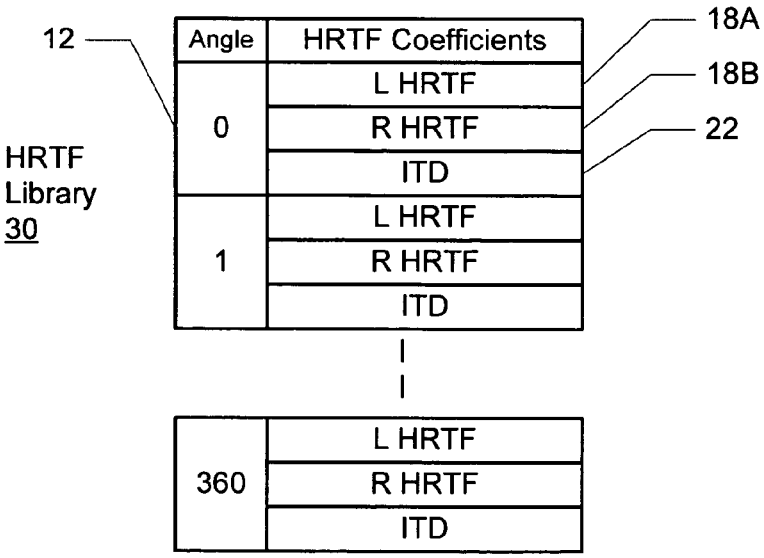
Prior Art FIG. 1B
FIG. 1B is a block diagram graphically illustrating how minimum phase versions HRTF measurements are conventionally stored.
Figure 2A:
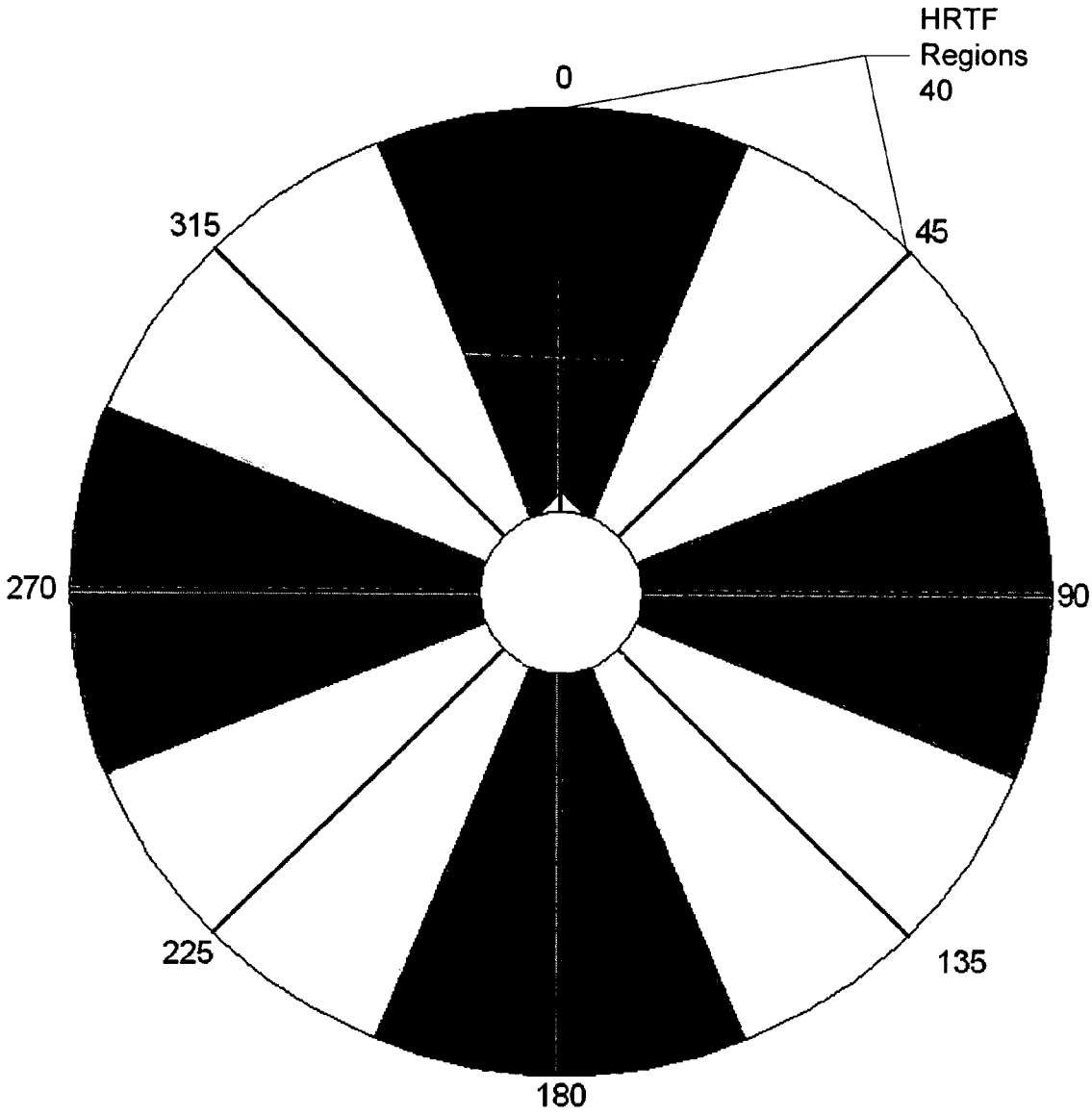
FIG. 2A is a graph that graphically shows an example of asymmetric HRTF/ITD storage according to the present invention.

FIG. 2A is a graph that graphically shows an example of asymmetric HRTF/ITD storage according to the present invention. Sound samples from an input sound may be associated with radial angles that range from zero to 360°, which are shown in the graph. In this specific example, HRTF regions 40 in 45° increments have been created, where a single HRTF 18 is assigned to, and stored, for each of the resulting HRTF regions 40. Since there are eight HRTF regions 40, only eight HRTFs need to be stored to process an input sound. In a preferred embodiment, the HRTFs are assigned to an angle value at the center of each respective region 40. In this example, the HRTFs are stored in association with angle values of 0°, 45°, 90°, etc., and each region 40 extends 22.5° in each direction from the HRTF. In an alternative embodiment, the HRTFs may be assigned to an angle value at the beginning or end the HRTFs regions 40.

Any input sound samples having a specified source angle 12 of that falls in a one of the HRTF regions 40 will be processed with the HRTF that lies in the center of that region 40, while still using the ITD 22 for the specific source angle 12. In a preferred embodiment, the specified source angle 12 is associated with one of the HRTF regions 40 by rounding the specified source angle to the nearest HRTF angle.

Figure 2B:
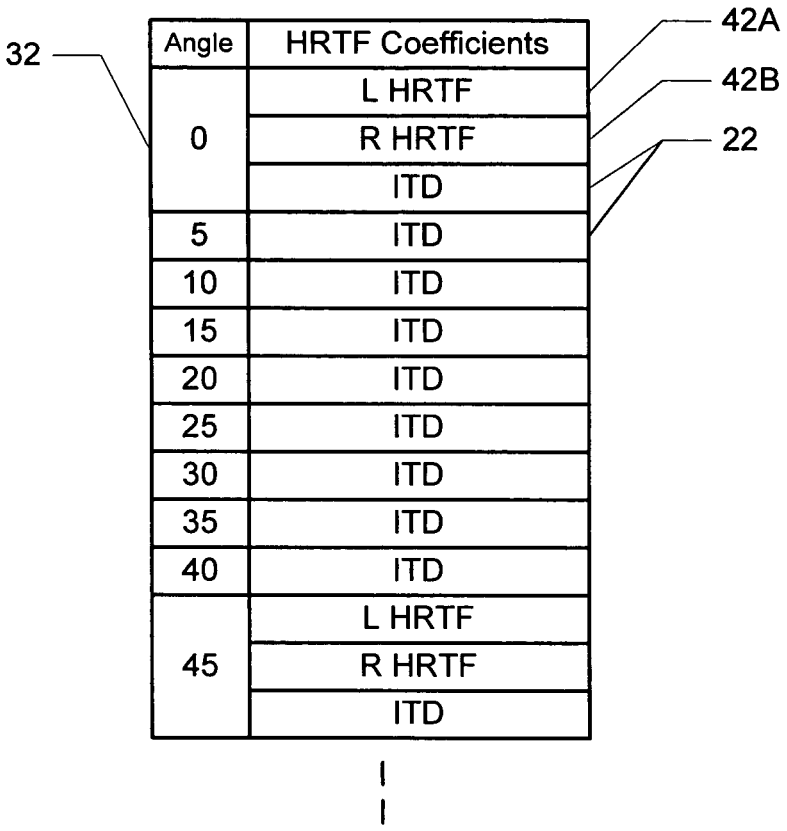
FIG. 2B is a block diagram graphically illustrating asymmetric HRTF/ITD storage, where HRTFs are stored in 45° increments, and ITDs are selected based on ° source angle increments.

FIG. 2B is a block diagram graphically illustrating asymmetric HRTF/ITD storage, where HRTFs 42 are stored in 45° increments, and ITDs 22 are selected based on 5° source angle increments 12. As shown, because a set of left and right HRTF coefficients 42*a* and 42*b* do not have to be stored for every source angle increment 12, the present invention effectively reduces HRTF storage requirements for 3-D sound processors. In a preferred embodiment of the present invention, ITDs 22 are selected based on 3° source angle increments 22, while HRTFs are stored in 9° increments, however, the ratio chosen between the source or ITD angle increment 12 and the larger HRTF angle increment may be largely a matter of the hardware environment.

If a reduction in storage requirements is not desired, but an increase in the filter order is, one could increase the filter order of each of the stored HRTFs 18 by three times to improve the quality of the filters. For example, the ITD 22 may be selected in 5-degree increments, while the HRTFs 18 are stored in 15-degree increments, creating twenty-four HRTF regions 40. In this example, input sound samples having a specified source angle of 355°, 0°, and 5°, for instance, would all be processed with the HRTF assigned to the 0° HRTF regions. Similarly, the HRTF assigned to the 30° HRTF region would be used to process sound positioned at 25°, 30°, or 35°. The savings in HRTF data storage requirements is threefold, which could help considerably in die or board cost. And because the more dominant 3D positioning cue, the ITD 22, is varied at all 5-degree angle 5-degree angle increments, even those angles that use the same HRTF coefficients will be perceived as distinct 3D positions.

Figure 3:
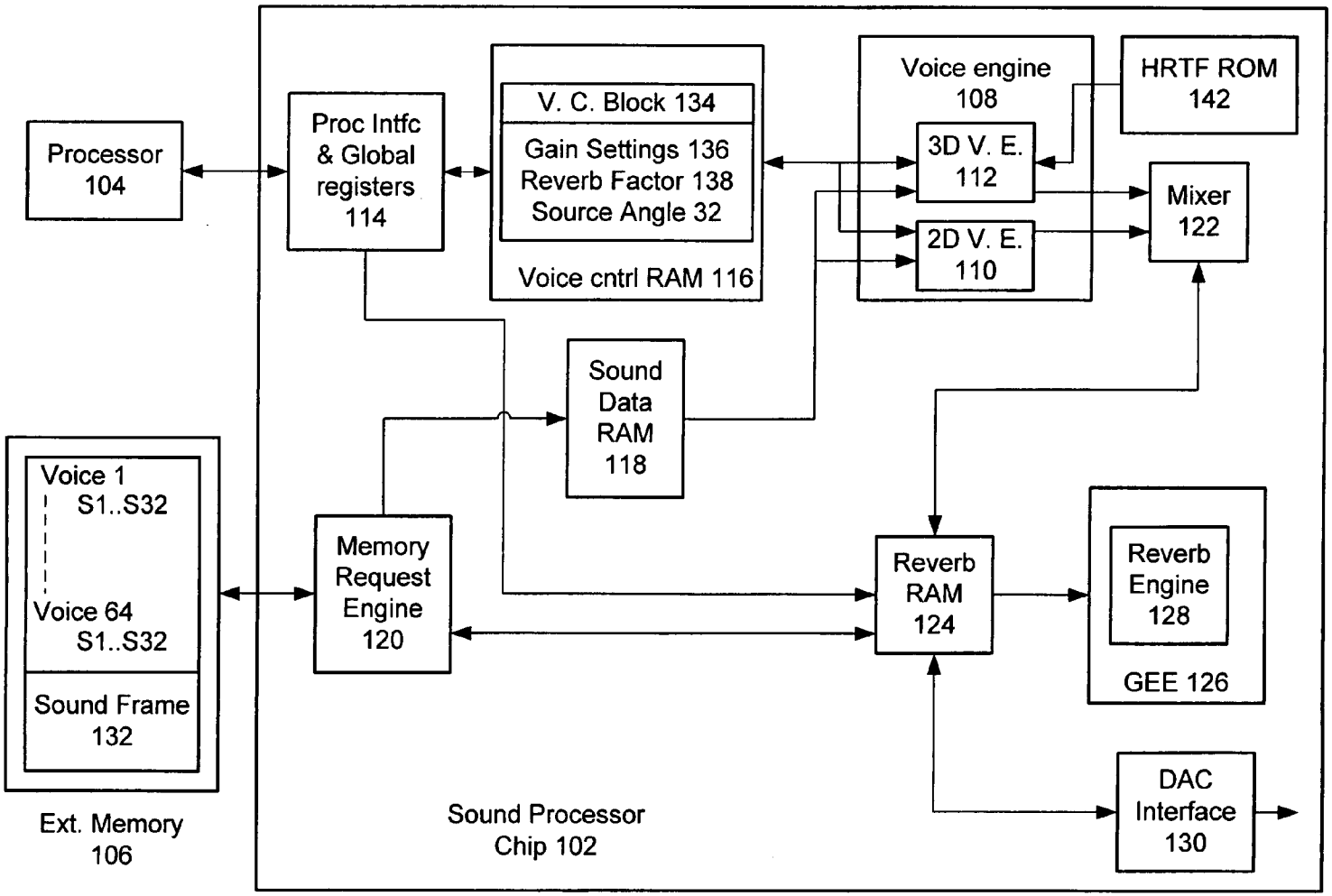
FIG. 3 is a diagram illustrating a sound processing system for implementing asymmetric HRTF/ITD storage in accordance with a preferred embodiment of the present invention.

FIG. 3 is a diagram illustrating a sound processing system for implementing asymmetric HRTF/ITD storage in accordance with a preferred embodiment of the present invention. The sound processing system 100 includes a sound processor chip 102 that interacts with an external processor 104 and external memory 106. The sound processor chip 102 includes a voice engine 108, which optionally includes separate 2-D and 3-D voice engines 110 and 112, an HRTF ROM 142, a processor interface and global registers 114, a voice control RAM 116, a sound data RAM 118, a memory request engine 120, a mixer 122, a reverberation RAM 124, a global effects engine 126, which includes a reverberation engine 128, and a digital-to-analog converter (DAC) interface 130.

Sound is input to the sound processor chip 102 from the external memory 106 as a series of sound frames 112. Each sound frame 132 comprises sixty-four voices, and each voice includes thirty-two samples. The voice engine 108 processes each of the sixty-four voices of a frame 132 one at a time. A voice control block 134 stored in the voice control RAM 116 stores the settings that specify how the voice engine 108 is to process each of the sixty-four voices. The voice engine 108 begins by reading the voice control block 134 to determine the location of the input sound and sends a request to the memory request engine 120 to fetch the thirty-two samples of the voice being processed. The thirty-two samples are then stored in the sound data RAM 118 and processed by the voice engine 108 according to the contents of the corresponding control block 134.

The settings stored in the voice control block 134 include gain settings 136, the reverberation factor 138, and the source angle 12 used by the present invention. During processing of the sound, the contents of the control block 134, including the source angle 12, are altered by a high-level program (not shown) running on the processor 104. The processor interface 114 accepts the commands from the processor 104, which are first typically translated down to AHB bus protocol.

The voice engine 108 reads the values from the control block 134 and applies the gain and reverberation factors 136 and 138 to produce attenuated values for both channels. The 3D voice engine 112 uses the source angle 12 to select an ITD value 22, and the ITD value 22 is then applied to the sound samples. The 3D voice engine also processes the sound sample with an HRTF from the HRTF ROM 142 that is associated with the HRTF region 40 in which the source angle falls.

After the 3D and 2D voice engines 110 and 112 process the sound samples, the values are then sent to the mixer 122, which maintains different banks of memory in the reverb RAM 124, including a 2-D bank, a 3-D bank and a reverb bank (not shown) for storing processed sound. After all the samples are processed for a particular voice, the global effects engine 126 inputs the data from the reverb RAM 124 to the reverb engine 128. The global effects engine 126 mixes the reverberated data with the data from the 2-D and 3-D banks to produce the final output. This final output is input to the DAC interface 130 for output to a DAC to deliver the final output as audible sound.

Figure 4:
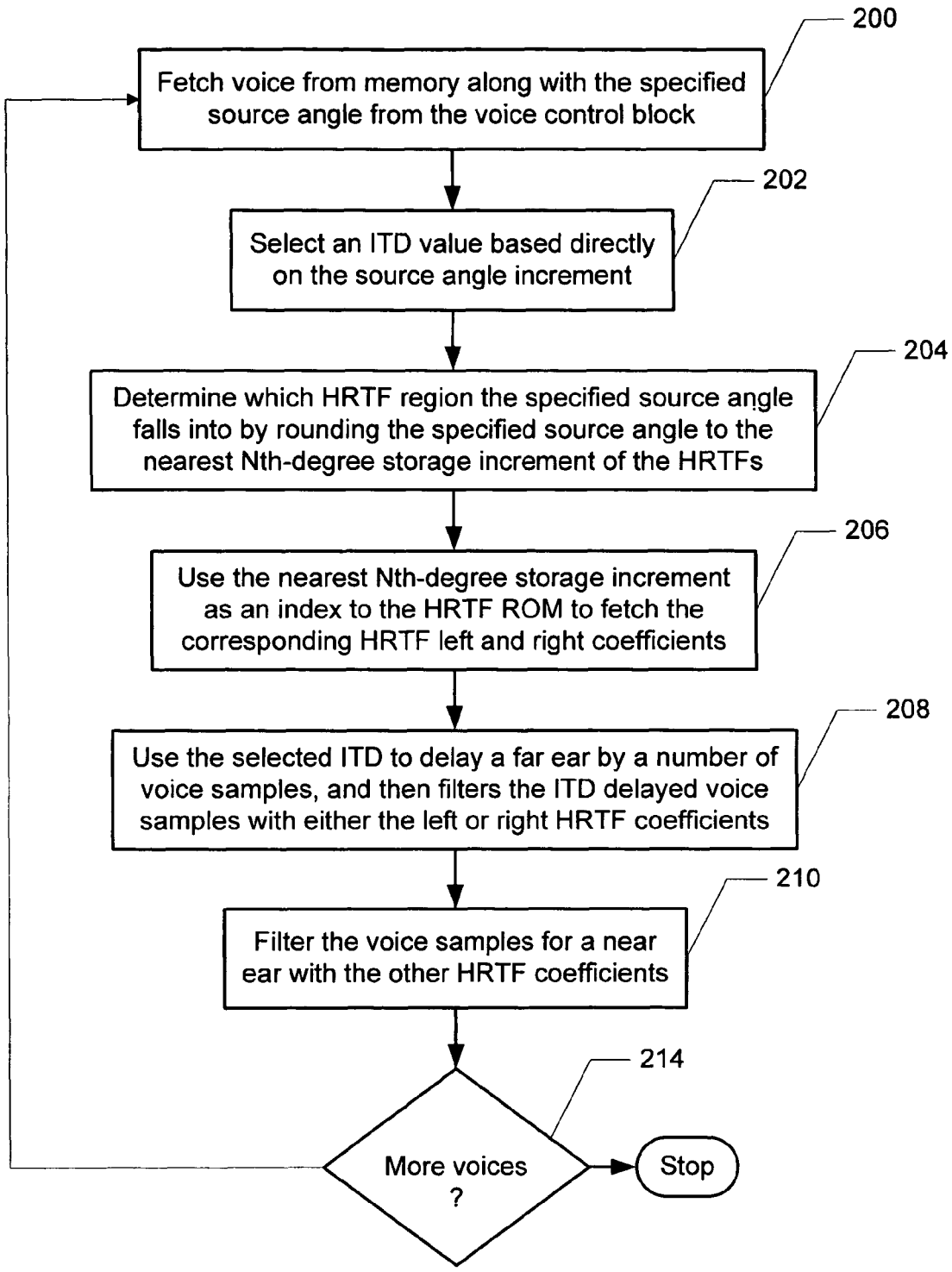
FIG. 4 is a flow diagram illustrating a process for reducing storage requirements for 3-D sound processor by providing asymmetric HRTF/ITD storage.

FIG. 4 is a flow diagram illustrating a process for reducing storage requirements for 3-D sound processor by providing asymmetric HRTF/ITD storage. The process assumes that a set of HRTFs 42 have been prestored in the HRTF ROM 142 in multiple-degree increments. The process performed by sound processor 102 begins in step 200 when a voice is fetched from memory 106 along with a specified source angle 12 from the voice control block 134 for processing by the 3-D voice engine 112. In step 202, 3-D voice engine 112 then selects an ITD value 22 based directly on the source angle increment, which is a programmed value. As stated above, the ITD value 22 may be either calculated in real-time directly from the source angle increment, or a set of ITD values 22 corresponding to all the source angle increments may be stored in the HRTF ROM 142, as shown in FIG. 2B.

Referring again to FIG. 4, in step 204 the 3-D voice engine 112 determines which HRTF region 40 the specified source angle 12 falls into by rounding the specified source angle 12 to the nearest Nth-degree storage increment of the HRTFs 42 that are stored in the HRTF ROM 142. For example, if the specified source angle 12 is 5° and the HRTFs are stored in 9° increments, then the source angle 12 is rounded to 9°.

In step 206, the nearest Nth-degree storage increment is then used as an index to the HRTF ROM 142 to fetch the corresponding HRTF left and right coefficients 42A and 42B. In step 208, the 3-D voice engine 112 uses the selected ITD 22 to delay a far ear by a number of voice samples, and then filters the ITD delayed voice samples with either the left or right HRTF coefficients depending on whether the left or right ear is the far ear. In step 210, the 3-D voice engine 112 filters the voice samples for a near ear with the other HRTF coefficients. If there are more voices to process in step 214, the process continues. Otherwise, the process ends.

A method and system for reducing storage requirements for 3-D sound processor through asymmetric HRTF/ITD storage has been disclosed. The present invention has been described in accordance with the embodiments shown, and one of ordinary skill in the art will readily recognize that there could be variations to the embodiments, and any variations would be within the spirit and scope of the present invention. Accordingly, many modifications may be made by one of ordinary skill in the art without departing from the spirit and scope of the appended claims.

I claim:

1. A method for producing 3-D sound, comprising:

storing a first left HRTF and a first right HRTF to produce a first 3-D sound to be perceived within a first source angle range;

storing a first plurality of interaural time difference (ITD) values, said first plurality of ITD values specified at a selected source angle increment, each of said first plurality of ITD values for use at a unique source angle, specified at said selected source angle increment, within said first source angle range;

storing a second left HRTF and a second right HRTF to produce a second 3-D sound to be perceived within a second source angle range, said first source angle range and said second source angle range not overlapping;

storing a second plurality of ITD values, said second plurality of ITD values specified at said selected source angle increment, each of said second plurality of ITD values for use at a unique source angle, specified at said selected source angle increment, within said second source angle range;

receiving a source angle specified at said selected source angle increment that is within said first source angle range;

receiving, in a sound processor, an ITD value corresponding to the source angle that is from said first plurality of ITD values;

retrieving said first left HRTF and said first right HRTF for generating a 3-D sound from an input sound; and, generating the 3-D sound for output as audible sound based on the retrieved said first left HRTF and said first right HRTF and the received ITD value corresponding to the source angle.

2. The method of claim 1 further comprising: assigning said first left HRTF and said first right HRTF to an angle value at a center of said first source angle range.

3. The method of claim 2 further comprising: processing the input sound with the received ITD value and rounding the received source angle to a nearest HRTF angle value.

4. The method of claim 1 wherein said first left HRTF, said first right HRTF, said second left HRTF, and said second right HRTF are stored in an HRTF ROM in a sound processor.

5. The method of claim 1 wherein said specified source angle increment is approximately 3°, and said first source angle range and said second source angle range span approximately 9°.

6. A system producing 3-D sound, comprising:

means for storing a first left HRTF and a first right HRTF to produce a first 3-D sound to be perceived within a first source angle range;

means for storing a first plurality of interaural time difference (ITD) values, said first plurality of ITD values specified at a selected source angle increment, each of said first plurality of ITD values for use at a unique source angle, specified at said selected source angle increment, within said first source angle range;

means for storing a second left HRTF and a second right HRTF to produce a second 3-D sound specified within a second source angle range, said first source angle range and said second source angle range not overlapping;

storing a second plurality of ITD values, said second plurality of ITD values specified at said selected source angle increment, each of said second plurality of ITD values for use at a unique source angle, specified at said selected source angle increment, within said second source angle range;

means for receiving a source angle specified at said selected source angle increment that is within said first source angle range;

means for receiving an IT value corresponding to the source angle that is from said first plurality of ITD values;

means for retrieving said first left HRTF and said first right HRTF for generating a 3-D sound from an input sound; and, means for generating the 3-D sound for output as audible sound based on the retrieved first left HRTF and first right HRTF and the received ITD value corresponding to the source angle.

7. The system of claim 6 wherein said first left HRTF and said first right HRTF are assigned to an angle value at a center of said first source angle range.

8. The system of claim 7 wherein the input sound is processed with the received ITD value and rounding the received source angle to a nearest HRTF angle value.

9. The system of claim 6 wherein the HRTFs said first left HRTF, said first right HRTF, said second left HRTF, and said second right HRTF are stored in an HRTF ROM in a sound processor.

10. The system of claim 6 wherein the ITDs are received specified at the source angle increment of approximately 3°, and said first source angle range and said second source angle range span approximately 9°.

11. A method for producing 3-D sound to be perceived at a source angle from an input sound having a specified source angle increment, comprising:

receiving the source angle specified according to the specified source angle increment;

receiving HRTFs stored in a ROM in multiple-degree increments, creating multiple HRTFs regions, wherein each respective HRTF includes left and right coefficients, wherein each HRTF corresponds to a respective region of angles comprising a plurality of source angle increments such that each HRTF is associated with a respective plurality of source angles specified at the specified source angle increment and each HRTF corresponds to one of a plurality of sets of ITD values;

receiving an ITD value corresponding to the source angle, the ITD value being a member of a set of ITD values such that each of the set of ITD values correspond to a source angle value that is specified at the specified source angle increment, the set of ITD values being one of the plurality of sets of ITD values;

determining which HRTF region the received source angle value falls into by rounding the received source angle value to the nearest Nth-degree storage increment of the HRTFs stored in the ROM;

using the nearest Nth-degree storage increment as an index to the ROM to fetch the corresponding HRTF;

using the received ITD to delay a far ear by a number of voice samples;

filtering the ITD delayed voice samples by fetched HRTF using either the left or right HRTF coefficients depending on whether the left or right ear is the far ear; and filtering the voice samples for a near ear with the other HRTF coefficient;

generating a 3-D sound for output as a plurality of audible sounds based on the filtered ITD delayed voice samples and the filtered voice samples.

12. The method of claim 11 further comprising: calculating the received ITD in real-time directly from the source angle.

13. The method of claim 11 further comprising: receiving the ITD value from a set of ITD values stored in the ROM in association with a set of source angle values that are specified at the specified source angle increment.

14. A method for producing 3-D sound, comprising:

selecting a first plurality of interaural time difference (ITD) values based on an input sound angle specified at a selected input sound angle increment, each of said first plurality of ITD values for use at a unique source angle, specified at said selected input sound angle increment, within a first source angle range;

storing a first left HRTF and a first right HRTF for a region of input sound angle values specified at the input sound angle increment and to be perceived within the first source an range, the region of input sound angle values comprising multiple input sound angle increments;

storing a second left HRTF and a second right HRTF to produce a second 3-D sound to be perceived within a second source angle range, said first source angle range and said second source angle range not overlapping;

selecting a second plurality of ITD values, said second plurality of ITD values specified at said selected input sound angle increment, each of said second plurality of ITD values for use at a unique source angle, specified at said selected input sound angle increment, within said second source angle range;

receiving a source angle specified at said selected input sound angle increment that is within said first source angle range;

receiving, in a sound processor, an ITD value corresponding to the source angle that is from said first plurality of ITD values;

retrieving said first left HRTF and said first right HRTF for generating a 3-D sound from an input sound; and, generating the 3-D sound for output as audible sound based on the retrieved said first left HRTF and said first right HRTF and the received ITD value corresponding to the input sound angle.

* * * * *